US008931877B1

(12) United States Patent
Rodriguez et al.

(10) Patent No.: US 8,931,877 B1
(45) Date of Patent: Jan. 13, 2015

(54) METHOD AND APPARATUS FOR CONTROLLING PRINTHEAD MOTION WITH A FRICTION TRACK BALL

(71) Applicant: Xerox Corporation, Norwalk, CT (US)

(72) Inventors: Jorge M. Rodriguez, Webster, NY (US); Jeffrey John Bradway, Rochester, NY (US); Frank Berkelys Tamarez Gomez, Rochester, NY (US); Matthew D. Savoy, Webster, NY (US); Jeffrey Swing, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 20 days.

(21) Appl. No.: 13/944,986

(22) Filed: Jul. 18, 2013

(51) Int. Cl.
*B41J 29/393* (2006.01)
*B41J 2/145* (2006.01)

(52) U.S. Cl.
CPC ..... *B41J 2/145* (2013.01)
USPC ..... 347/19

(58) Field of Classification Search
None
See application file for complete search history.

(56) References Cited

U.S. PATENT DOCUMENTS

| | | | | |
|---|---|---|---|---|
| 5,975,666 | A * | 11/1999 | Kawaguchi | 347/8 |
| 6,271,869 | B1 * | 8/2001 | Tada et al. | 347/116 |
| 6,802,381 | B1 | 10/2004 | Koors et al. | |
| 7,918,526 | B2 * | 4/2011 | Nobuta et al. | 347/19 |
| 8,038,240 | B2 | 10/2011 | Tsai | |
| 8,322,821 | B2 | 12/2012 | Tsai et al. | |

* cited by examiner

*Primary Examiner* — Lamson Nguyen
(74) *Attorney, Agent, or Firm* — Maginot Moore & Beck LLP

(57) ABSTRACT

An apparatus enables alignment of the position of a printhead independent of other printheads in a printhead assembly. The apparatus includes a printhead configured to eject ink onto an image receiving member, a plate to which the printhead can be rigidly mounted and selectively removed, and a translation carriage to which the plate is rigidly mounted. The apparatus also includes a track ball operatively coupled to two actuators for movement of the plate in an X and a roll direction relative to the translation carriage.

20 Claims, 8 Drawing Sheets

METHOD AND APPARATUS FOR CONTROLLING PRINTHEAD MOTION WITH A FRICTION TRACK BALL

TECHNICAL FIELD

This disclosure relates generally to imaging devices having multiple printhead assemblies, and more particularly, to the alignment of printheads in such imaging devices.

BACKGROUND

Some ink printing devices use a single printhead, but many use a plurality of printheads. For example, seven printheads may be arranged in two rows with one row having three printheads and one row having four printheads. The printheads in the first row are separated by gaps having a distance approximately equivalent to the width of a printhead. The printheads in the second row are positioned to align with the gaps between the printheads in the first row. This arrangement is called a staggered full width array (SFWA) printhead assembly and an exemplary embodiment of a SFWA assembly is shown in FIG. 1.

Synchronizing the passage of an image receiving member with the firing of the inkjets in the printheads enables a continuous ink image to be formed across the member in the direction perpendicular to the direction of member passage. Alignment of the ink drops ejected by the printheads, however, may not be as expected. Each printhead in the printhead assembly has up to three degrees of positional freedom. The printheads need to be precisely aligned to provide a smooth transition from the ink drops ejected by one printhead to the ink drops printed by the other printheads in the assembly. Misalignment of printheads may occur from, for example, printheads failing to meet manufacturing tolerances, thermal expansion of the printhead and associated parts of the printer, vibration of the printhead, or the like.

The possible degrees of movement for a printhead are now discussed with reference to FIG. 2. In general, a printhead 204 that is not attached within a printhead assembly is rotatable about each axis of an XYZ set of axes as shown in the figure. Rotation about the Y axis is called yaw, rotation about the X axis is called pitch, and rotation about the Z axis is called roll. Additionally, in general, a printhead 204 that is not attached within a printhead assembly is also translatable along any one of the axes. These rotations and translations constitute the possible six degrees of freedom of movement for a printhead that is not attached within a printhead assembly. A printhead that is attached within a printhead assembly, however, only has three degrees of freedom, X, Y, and roll, due to fixation of the printhead within the printhead assembly. Changes in printhead position may result from factors such as mechanical vibrations and other sources of disturbances on the machine components, which may alter printhead positions and/or angles with respect to an image receiving surface.

Misalignments between printheads in three of the six degrees of freedom may be categorized as roll or stitch errors. Roll errors can occur when a printhead rotates about an axis normal to the imaging member. Roll error causes a skew in the rows of ink drops ejected by the printhead relative to the imaging member. This skew may be noticeable at the interface between two printheads and may cause an objectionable streak. Stitch errors arise when the printhead shifts in the process (Y) direction or the cross-process (X) direction. These errors result in misalignment of drops from one printhead with the drops of another printhead.

In the case of Y-direction stitch errors, the drops in the rows of one printhead are shifted up or down from the drops in the rows of a neighboring printhead. In the case of X-direction stitch errors, the first and last drops in the rows printed by the shifted printhead are too close or too far from the last and first drops, respectively, in the rows printed by the neighboring printheads. Of course, if the shifted printhead is the first or last printhead in the assembly, shifting of the first drop or the last drop in the rows, respectively, does not occur at an intersection with another printhead. Thus, aligning printheads in a printhead assembly with sufficient accuracy to allow high image quality is desired.

To adjust the printhead position to correct for printhead misalignments, one previously known printhead assembly uses a right-angle lever arm that pivots to push a plate to which a printhead is mounted. The movement of the printhead in this assembly is limited by the length of the lever arm. Additionally, movement of the lever arm may produce backlash and compensation for this backlash must be incorporated in the movement of the arm to properly adjust the position of the printhead. Printhead adjustment systems that operate with little or no backlash and that possess an increased range of movement are desirable.

SUMMARY

An apparatus enables the position of a printhead to be independently aligned in an ink printing system. The apparatus includes a first member, a second member, a first rotational member, and a first driver. The first member is configured for selective mounting of the printhead. The first member is operatively connected to the second member. The first rotational member is operatively connected to the second member and is positioned to extend from the second member to the first member to frictionally engage the first member. The first driver is operatively connected to the first rotational member to rotate the first rotational member either to translate the first member laterally or to rotate the first member about an axis of the first rotational member.

A method enables independently aligning printhead position in an ink printing system. The method includes selectively mounting a printhead to a first member. The method also includes operatively connecting the first member to a second member. The method also includes operatively connecting a first rotational member to the second member and positioning the first rotational member to extend from the second member to the first member to frictionally engage the first member. The method also includes operatively connecting at least one driver to the first rotational member and rotating the first rotational member with the at least one driver either to translate the first member laterally or to rotate the first member about an axis of the first rotational member.

BRIEF DESCRIPTION OF THE DRAWINGS

The foregoing aspects and other features of an apparatus that enables the position of a printhead to be independently aligned in an ink printing system are explained in the following description, taken in connection with the accompanying drawings.

DETAILED DESCRIPTION

Figure 1:
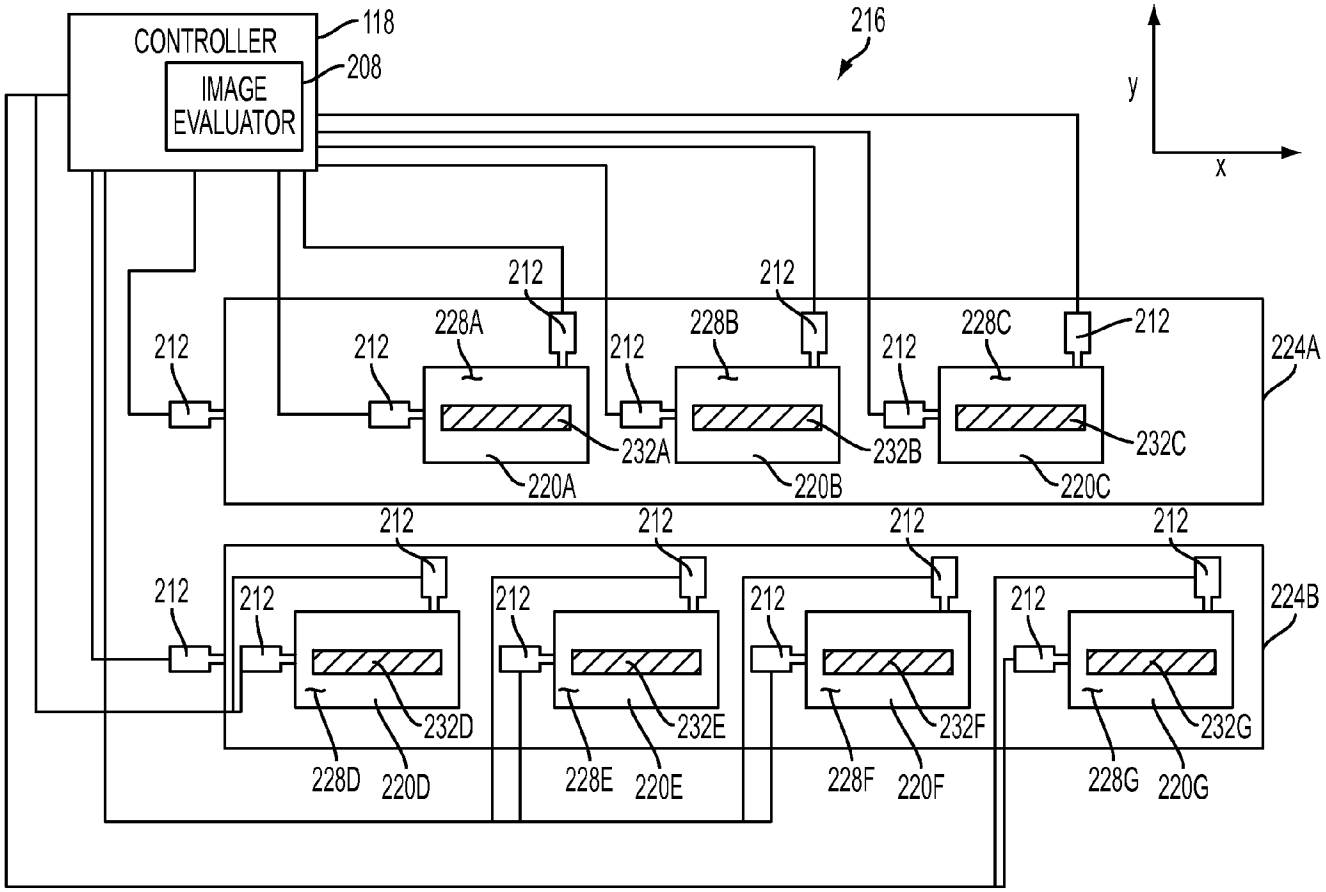
FIG. 1 is a schematic view of two staggered printhead assemblies comprising seven printheads.

For a general understanding of the environment for the system and method disclosed herein and the details for the system and method, reference is made to the drawings. In the drawings, like reference numerals have been used throughout to designate like elements. As used herein, the words "printer" and "imaging apparatus", which may be used interchangeably, encompasses any apparatus that performs a print outputting function for any purpose, such as a digital copier, bookmaking machine, facsimile machine, a multi-function machine, etc. Furthermore, a printer is an apparatus that forms images with marking material on media and fixes and/or cures the images before the media exits the printer for collection or further printing by a subsequent printer.

Figure 7:
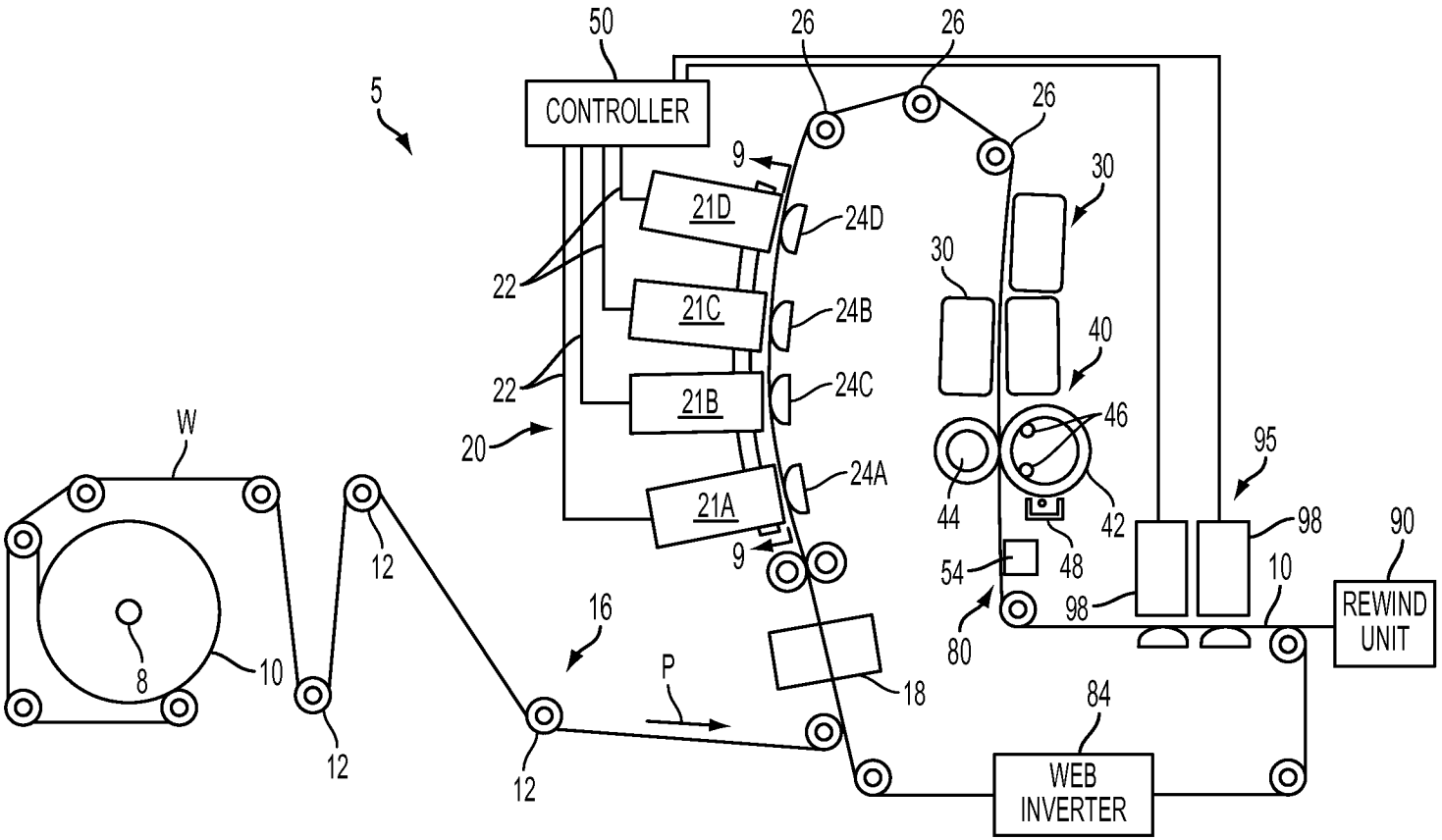
FIG. 7 PRIOR ART
FIG. 7 is a schematic view of a prior art inkjet printing apparatus in which the carriage plate may be mounted to the intermediate plate shown in FIG. 3.

FIG. 7 depicts an imaging apparatus 5 that uses the method described in this document to enable the position of a printhead to be independently aligned in an ink printing system. The imaging apparatus 5 can implement a solid ink print process for printing onto a continuous media web. Although the system and method disclosed herein is most beneficial in imaging apparatus in which the recording media passes the printheads only once, the system and method may also be used in imaging apparatus in which multiple passes occur to form an image. Furthermore, while the system and method are discussed in the context of a solid ink imaging apparatus, they can be used with imaging apparatus that use other types of liquid ink, such as aqueous, emulsified, gel, UV curable inks, or inks having magnetic properties such as those used in magnetic ink character recognitions systems ("MICR"). Therefore, the system and method can be used in any imaging apparatus that provides liquid ink to one or more printheads, including cartridge inkjet systems.

The imaging apparatus 5 shown in FIG. 7 forms a printed image on media by ejecting ink droplets from a plurality of inkjets arranged in one or more printheads. During the course of printing, one or more of the inkjets may become unavailable to eject ink. The system described herein implements a method of defective inkjet detection, which enables a user to detect defective inkjets in high density coverage areas and identify the defective inkjets through a user interface to enable a controller in the printer to compensate for the defective inkjets. For example, a functional inkjet, referred to as a compensating inkjet, can be used to eject ink in place of an identified defective inkjet. Once the defective inkjets are identified through the user interface, they are deactivated by a printer controller and no longer used for printing until a maintenance operation is performed, which may rehabilitate the defective inkjets.

The imaging apparatus 5 includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

The direct-to-sheet, continuous-media, phase-change inkjet imaging apparatus 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90.

The media 10 may be unwound from the source as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging apparatus. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units or modules 21A, 21B, 21C, and 21D, each color module effectively extends across the width of the media and is able to eject ink directly (i.e., without use of an intermediate or offset member) onto the moving media. The arrangement of printheads in the print zone of the system 5 is discussed in more detail with reference to FIG. 8 below.

The imaging apparatus may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color module is a backing member 24A-24D, typically in the form of a bar or roll, which is arranged substantially opposite the printheads on the back side of the media. Each backing member is used to position the media at a predetermined distance from the printheads opposite the backing member. Each backing member may be configured to emit thermal energy to heat the media to a predetermined temperature which, in one practical embodiment, is in a range of about 40° C. to about 60° C. The various backing members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

Following the printing station 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. Following the mid-heaters 30, a fixing assembly 40 is configured to apply heat and/or pressure to the media to fix the images to the media. The term "fixing" may refer to the stabilization of ink on media through components operating on the ink and/or the media, including, but not limited to, fixing rollers and the like. In the embodiment of the FIG. 7, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. The spreader 40 includes rollers, such as image-side roller 42 and pressure roller 44, to apply heat and pressure to the media. Either roller can include heat elements, such as heating elements 46, to bring the web W to a temperature in a range from about 35° C. to about 80° C.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink that has minimal impact on the final printed color, regardless of whether or not the ink is devoid of all colorant.

Following passage through the spreader 40, the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the electrical motor calibration function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the printheads of color modules 21A-21D in order to operate the printheads to form the test patterns with indicia described below to enable visual detection of defective inkjets.

The imaging apparatus 5 may also include an optical imaging system 54 that is configured for the imaging of the printed web. The optical imaging system is configured to detect, for example, the presence, intensity, and/or location of ink drops jetted onto the receiving member by the inkjets of the printhead assembly. The optical imaging system may include an array of optical detectors/sensors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from uninked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

Figure 8:
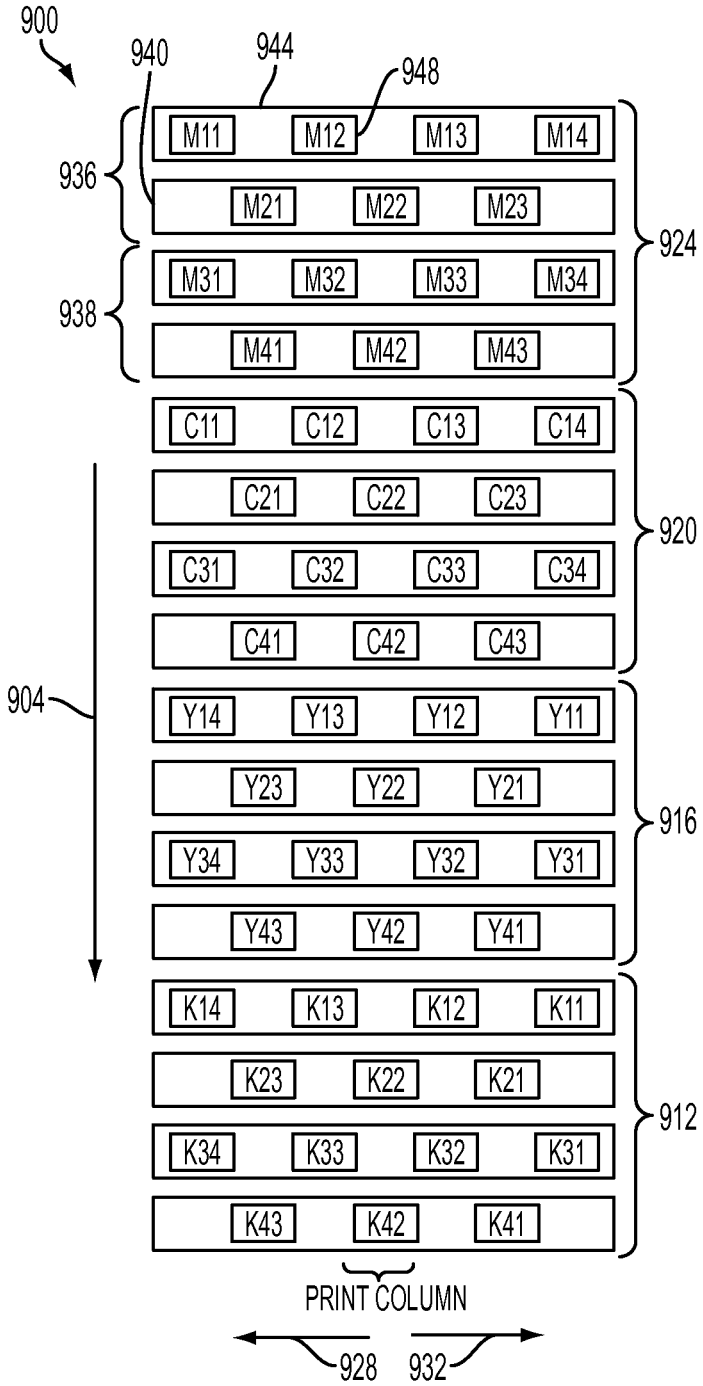
FIG. 8 PRIOR ART
FIG. 8 illustrates a schematic view of a prior art printhead configuration for use in FIG. 7.

A schematic view of a prior art print zone 900 that may be used in the imaging apparatus 5 is depicted in FIG. 8. The printheads of this print zone can be operated as described below to print a test pattern with indicia that enables visual detection of defective inkjets. The print zone 900 includes four color modules or units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as it travels under the color unit from color unit 924 to color unit 912. Each color unit includes two print arrays, which include two print bars each that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print bar array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

Referring now to FIG. 1, a schematic view of a printhead assembly 216 for a high-speed, or high throughput, multicolor image producing machine is shown. The assembly 216 is coupled to the controller 118 and includes a plurality of actuators 212. The assembly 216 has seven printheads 220A, 220B, 220C, 220D, 220E, 220F, and 220G arranged on two print bars 224A and 224B, and the actuators 212 are arranged to selectively control the movement of the print bars 224A, 224B and the printheads 220A-220G. The printheads on the upper print bar 224A and the printheads on the lower print bar 224B are arranged in a staggered pattern. Each printhead 220A-220G has a corresponding front face 228A-228G for ejecting ink onto media 10 (shown in FIG. 7) to form an image. The staggered arrangement enables the printheads to form an image across the full width of the media. In print mode the printhead front faces 228A-228G are disposed close, for example, about 23 mils, to the media 10. In one embodiment, each printhead front face 228A-228G is approximately 4 inches long.

The ejecting face, also known as the aperture plate, of each printhead 220A-220G includes a plurality of nozzles 232A-232G, respectively, that may be arranged in rows that extend in the cross-process direction (X axis) across the aperture plate. The spacing between each nozzle in a row is limited by the number of ink jets that can be placed in a given area in the aperture plate. To enable the printing of drops onto media at distances that are closer in the cross-process direction than the distance between adjacent nozzles in a row, the nozzles in one row of a printhead are offset in the cross-process direction (along the X axis) from the nozzles in at least some of the other rows in the printhead. The offset between nozzles in adjacent rows enables the number of ink drops in a printed row to be increased by actuating the inkjets in a subsequent row to eject ink as the drops ejected by a previous row arrive. Of course, other arrangements of nozzles are possible. For example, instead of having offset rows of nozzles, the nozzles may be arranged in a grid in the aperture plate with linear rows and columns of nozzles. Each printhead in an assembly may be configured to emit ink drops of each color utilized in the imaging device. In such a configuration, each printhead may include one or more rows of nozzles for each color of ink used in the imaging device. In another embodiment, each printhead may be configured to contain only one color of ink so the jets of the printhead eject the same color of ink. In this embodiment, an assembly of printheads may include fourteen printheads dedicated to each of cyan, magenta, yellow and black for a total of fifty-six printheads. In one embodiment, the plurality of nozzles within a printhead enables the printhead assembly to print an image that is approximately 17.5 inches wide in the cross-process direction.

As discussed above, misalignment of a printhead with respect to the receiving substrate and with respect to other printheads in the imaging device may present image quality issues. To facilitate independent alignment of printheads in a printhead assembly and enable more efficient replacement of printheads in the assembly, a tracking mechanism 320 has been incorporated in an intermediate plate 308 to which a printhead carriage plate 312 is mounted. A schematic illustration of the intermediate plate 308 and the carriage plate 312 is now discussed with reference to FIG. 3. For clarity, the tracking mechanism 320 is not shown in FIG. 3. The tracking mechanism 320 and other components of a printer are discussed in further detail below with reference to FIG. 4, FIG. 5, and FIG. 6.

Figure 3:
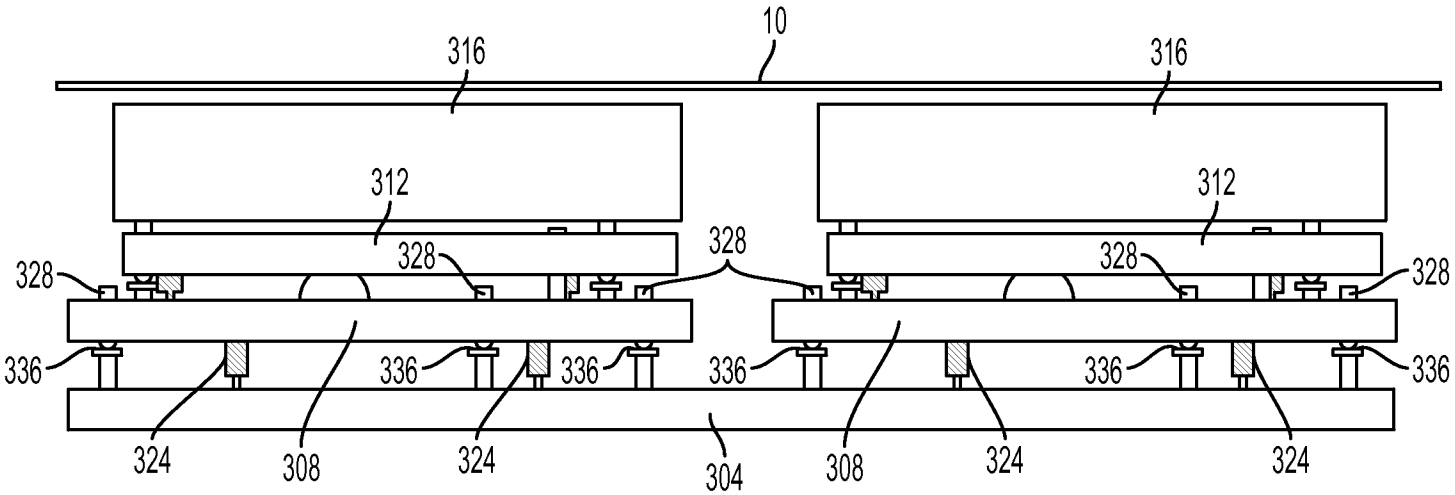
FIG. 3 is a schematic illustration of two printheads mounted to two carriage plates that are rigidly connected to an intermediate plate in a printer.

Turning to FIG. 3, a print bar 304 is provided within the imaging apparatus 5 (shown in FIG. 7) and is movable in the cross-process direction relative to the media 10. As shown, a number of intermediate plates 308 are coupled to a single print bar 304 by extension springs 324 and set screws 328. For each intermediate plate 308, two extension springs 324 bias the intermediate plate 308 toward the print bar 304 such that three set screws 328 having spherical tips and passing through the intermediate plates 308 are biased to rest on receiving surfaces 336 of the print bar 304. The intermediate plates 308 are positioned closer to the media 10 than the print bar 304 and are configured to move towards and away from media 10 by adjusting the set screws 328. This adjustment of the set screws 328 is performed during manufacturing processes and is not altered once the printer is assembled. Mounted to each intermediate plate 308 is a carriage plate 312, and within each carriage plate 312, a printhead 316 is rigidly mounted. Thus, movement of an intermediate plate 308 relative to the print bar 304 enables movement of printheads 316 relative to the print bar 304. All printheads 316 are able to be moved simultaneously by moving the print bar 304, and each printhead 316 is also able to be moved individually.

Figure 4:
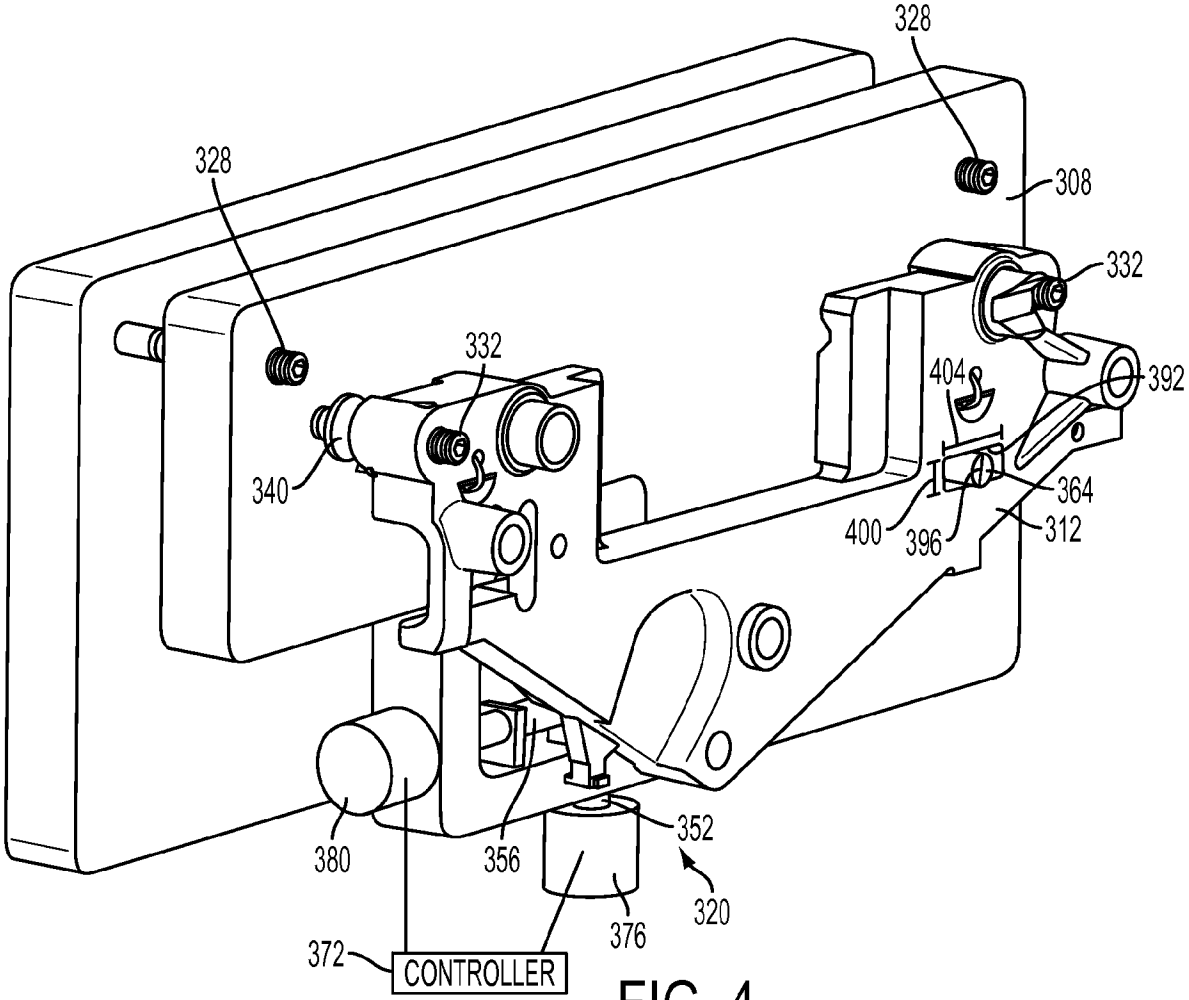
FIG. 4 is a front isometric elevation view of a carriage plate mounted to an intermediate plate.
Figure 5:
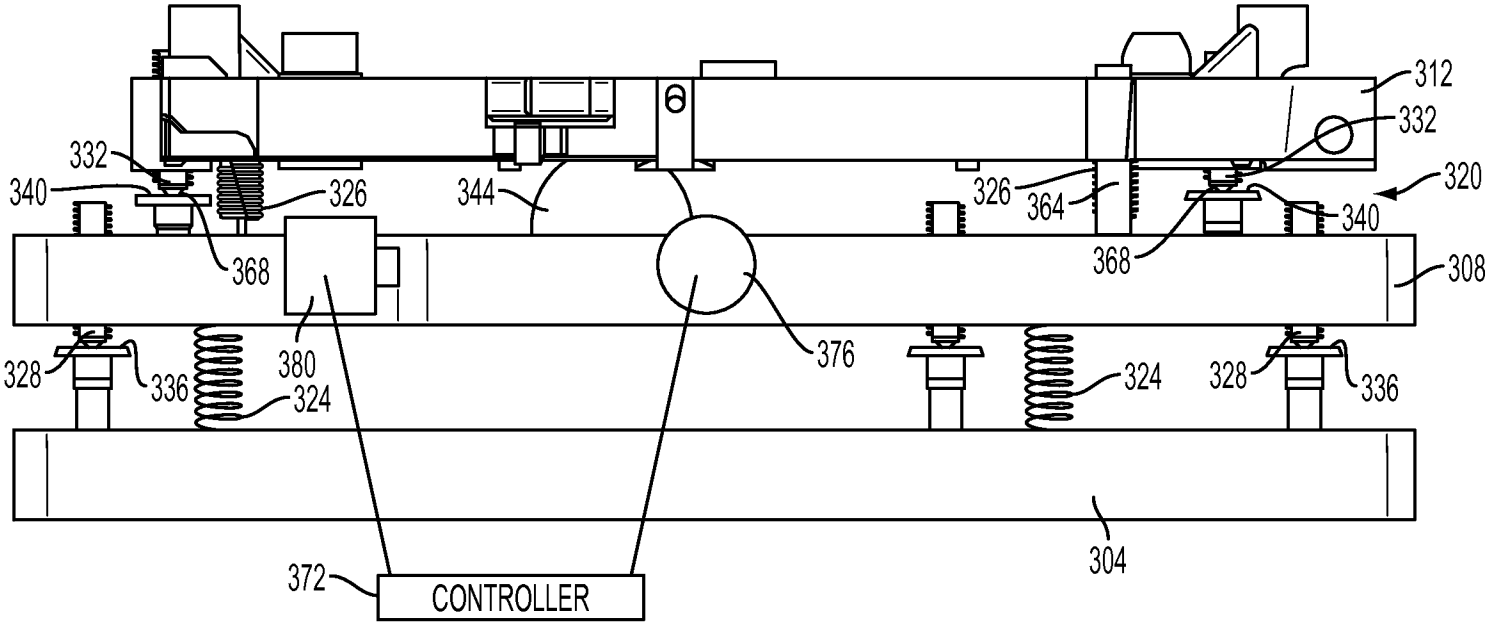
FIG. 5 is a top elevation view of the carriage plate mounted to the intermediate plate shown in FIG. 3.
Figure 6:
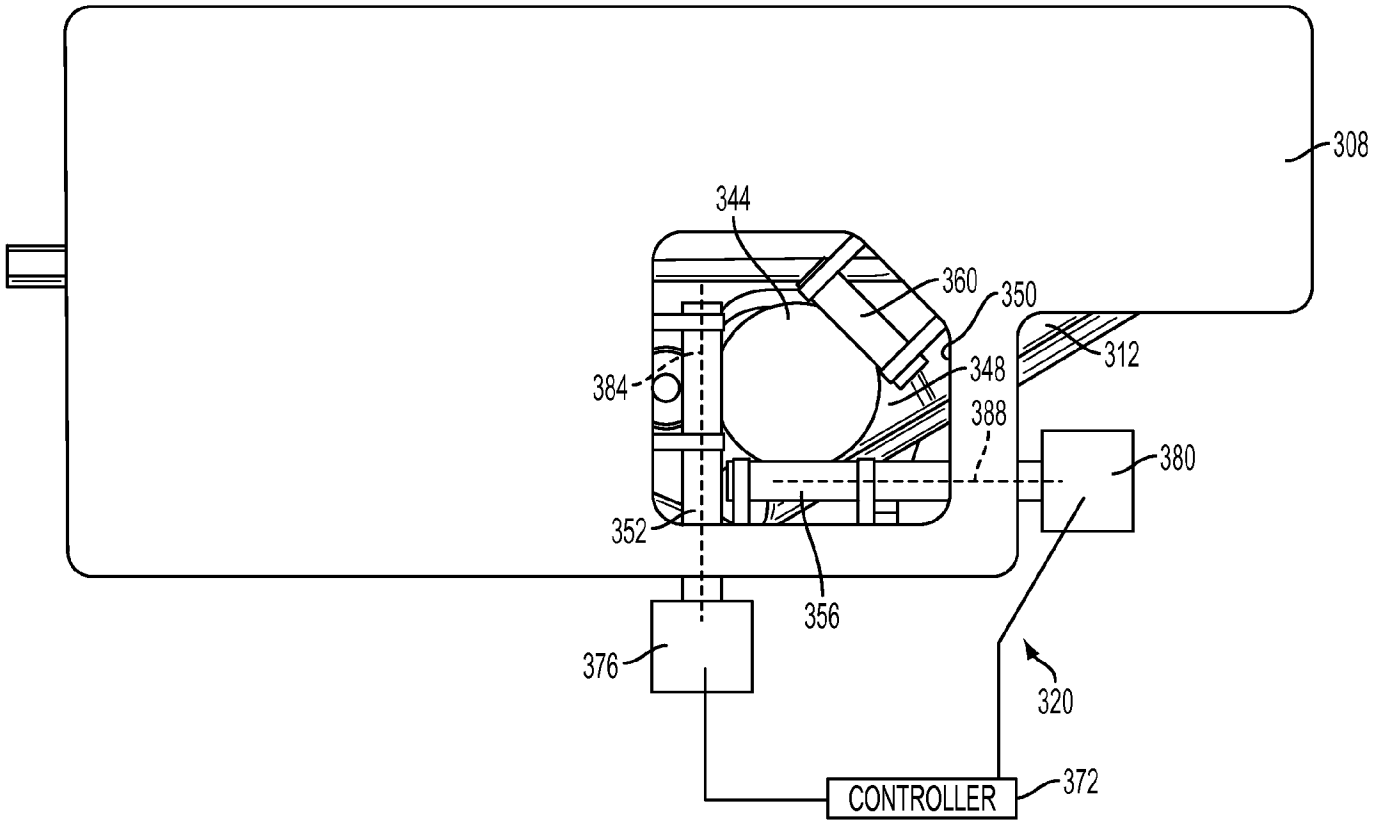
FIG. 6 is back elevation view of the carriage plate mounted to the intermediate plate shown in FIG. 3.

Turning now to FIG. 4, FIG. 5, and FIG. 6, a tracking mechanism 320 is incorporated in each intermediate plate 308 and is operated by an actuator for selective movement to selectively move a tracking member 344. The tracking member 344 in turn frictionally engages a portion of carriage plate 312 to selectively move the carriage plate 312 relative to the intermediate plate 308. The actuator is coupled to the tracking mechanism 320 through rotational linkages to move the tracking member 344 and the carriage plate 312. The actuator responds to signals from the controller 118 (shown in FIG. 1). A portion of the instructions executed by the controller 118 (shown in FIG. 1) implement an image evaluator 208 (shown in FIG. 1) that processes captured image data of test patterns to generate positional correction data for roll and stitch errors. Other processes implemented by the controller 118 (shown in FIG. 1) convert the positional correction data to stepper motor pulses or other control signals for operating the actuator and the tracking mechanism 320 to move the printheads 316 (shown in FIG. 3).

Figure 2:
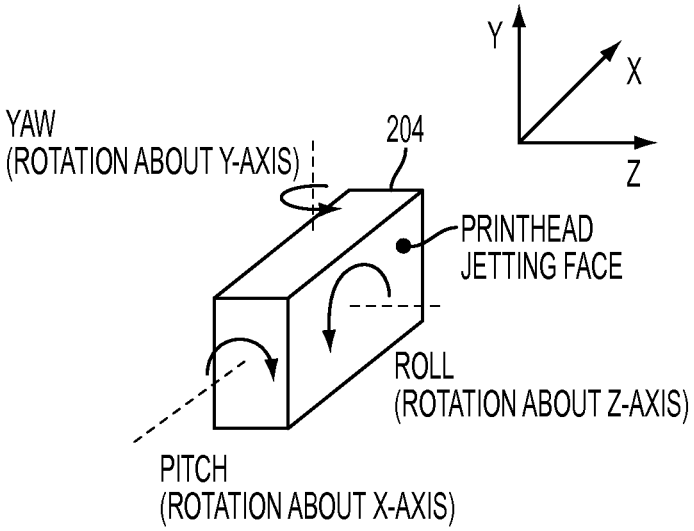
FIG. 2 is an illustration of degrees of freedom of movement for a printhead that is not mounted within a printhead assembly.

The tracking mechanism 320 within the intermediate plate 308 interacts with the tracking member, also referred to herein as a track ball 344, which engages the carriage plate 312 to enable independent alignment adjustment of the printhead 316 in two of the six degrees of freedom of movement. In particular, the intermediate plate 308 and the tracking mechanism 320 provide a plurality of contact points with the carriage plate 312 to constrain the carriage plate 312 in the Y, Z, pitch, and yaw directions relative to the intermediate plate 308 (see FIG. 2). Thus, the printhead 316 is fixed in relation to the intermediate plate 308 in Y, Z, pitch, and yaw directions. Additionally, however, the track ball 344 engages the carriage plate 312 to enable adjustment of the carriage plate 312 in the roll and X directions relative to the intermediate plate 308. Thus, the printhead 316 is movable in the roll and X directions relative to the intermediate plate 308.

More specifically, the tracking mechanism 320 includes two extension springs 326 (shown in FIG. 5), two set screws 332 (shown in FIG. 4 and FIG. 5), two receiving surfaces 340 (shown in FIG. 5), one track ball receiving area 348 (shown in FIG. 6), a tracking mechanism opening 350 formed in the intermediate plate 308, a first driven rotational member 352, a second driven rotational member 356, an idle rotational member 360 (shown in FIG. 6), and a pivot 364 (shown in FIG. 4 and FIG. 5). The tracking mechanism 320 extends into the tracking mechanism opening 350 and cooperates with the track ball 344 (shown in FIG. 5 and FIG. 6), to position the carriage plate 312. In other words, the track ball 344 is manipulated within the tracking mechanism 320 to adjust the position of the carriage plate 312, and thus the printhead 316, relative to the media 10 (shown in FIG. 3 and FIG. 7).

The extension springs 324 extend from the carriage plate 312 to the intermediate plate 308 and bias the carriage plate 312 and intermediate plate 308 toward one another. Tips 368 (shown in FIG. 5) of the screws 328, 332 rest against the receiving surfaces 336, 340 of the intermediate plate 308 and are retained in place against the receiving surfaces 336, 340 by the biasing force of the extension springs 324. The arrangement of the extension springs 324, screws 328, 332, and receiving surfaces 336, 340 help constrain the carriage plate 312 in the Z, pitch, and yaw directions (shown in FIG. 2) relative to the intermediate plate 308. In at least one embodiment, the tips 368 are spherically shaped to enable rotation on the receiving surfaces 336, 340.

The track ball 344 is spherically shaped and extends from the carriage plate 312 to the intermediate plate 308 and partially into the tracking mechanism opening 350 such that the track ball 344 contacts the track ball receiving area 348, formed in the carriage plate 312, and contacts the first driven rotational member 352, the second driven rotational member 356, and the idle rotational member 360, which are mounted to extend from the intermediate plate 308 in a direction substantially parallel with the intermediate plate 308 and the carriage plate 312. The first driven rotational member 352, the second driven rotational member 356, and the idle rotational member 360 are substantially cylindrically shaped and the round circumference of each rotational member 352, 356, 360 is in contact with the track ball 344. The contact between the track ball 344 and features of the tracking mechanism 320 retains the track ball 344 between the carriage plate 312 and the intermediate plate 308. More specifically, the idle rotational member 360 urges the track ball 344 into contact with the first driven rotational member 352 and the second driven rotational member 356. Additionally, the contact of the track ball 344 with features of the tracking mechanism 320 is frictional such that movement of the first driven rotational member 352 and/or the second driven rotational member 356 relative to the intermediate plate 308 results in corresponding movement of the track ball 344 relative to the intermediate plate 308, in turn resulting in corresponding movement of the carriage plate 312 relative to the intermediate plate 308.

The tracking mechanism 320 further includes a controller 372 operatively connected to an output shaft of a first driver 376 and an output shaft of a second driver 380 to selectively operate the first driver 376 and the second driver 380. In at least one embodiment, the controller 372 is integrated with the controller 118 (shown in FIG. 1 and FIG. 7). The first driver 376 is operatively connected to the first driven rotational member 352 to rotate the first driven rotational member 352 about a first axis 384 (shown in FIG. 6), and the second driver 380 is operatively connected to the second driven rotational member 356 to rotate the second driven rotational member 356 about a second axis 388 (shown in FIG. 6). In at least one embodiment, the first driven rotational member 352 and the second driven rotational member 356 are arranged substantially orthogonally to one another, and the idle rotational member 360 is arranged at substantially a 45 degree angle between the first driven rotational member 352 and the second driven rotational member 356. Accordingly, the first axis 384 is arranged substantially orthogonally to the second axis 388.

The pivot 364 extends from the intermediate plate 308 to the carriage plate 312 and is received through a slot 392 (shown in FIG. 4) formed in the carriage plate 312. The pivot 364 has a diameter 396 (shown in FIG. 4) which is very slightly smaller than a longitudinal dimension 400 of the slot 392 (shown in FIG. 4) and is substantially smaller than a lateral dimension 404 of the slot 392 (shown in FIG. 4). In other words, the pivot 364 fits tightly within the slot 392 and can slide along the lateral dimension 404 of the slot 392.

The arrangement of the tracking mechanism 320 is such that contact between the rotational members 352, 356, 360, the track ball 344, and the track ball receiving area 348 assists the extension spring 324, 326, the screws 328, 332, and the receiving surfaces 336, 340 in constraining the carriage plate 312 in the Z, pitch, and yaw directions. Additionally, contact between the pivot 362 and the slot 392 in the carriage plate 312 constrains the carriage plate 312 in the Y direction relative to the intermediate plate 308 because the pivot 364 only slides along the lateral dimension 404 of the slot 392. Accordingly, the arrangement of the tracking mechanism 320 allows movement of the carriage plate 312 in the roll and X directions only.

In operation, the controller of a printing system is configured with programmed instructions for implementing the roll and X direction positional displacement correction data adjustment processes. During the life of the imaging system, the controller selects and operates the processes in accordance with a schedule or as they are activated manually. The processes generate test patterns, capture images of the test patterns, and evaluate the captured image data of the test patterns, to generate roll and X direction positional correction data. These data are used to generate control signals for the first driver 376 and second driver 380 that are coupled to the first driven rotational member 352 and the second driven rotational member 356, respectively.

The output shaft of the first driver 376 rotates the first driven rotational member 352 about the first axis 384. The first driven rotational member 352 is configured to rotate about the first axis 384 in both clockwise and counter-clockwise directions. Due to frictional contact with the track ball 344, rotation of the first driven rotational member 352 in the clockwise direction (when viewed from the perspective shown in FIG. 5) rotates the track ball 344 in the counter-clockwise direction. Frictional contact between the track ball 344 and the carriage plate 312 at the track ball receiving area 348 enables rotation of the track ball 344 in the counter-clockwise direction (when viewed from the perspective shown in FIG. 5) and applies force in a leftward direction to the carriage plate 312 to move the carriage plate 312 leftwardly (when viewed from the perspective shown in FIG. 5). Conversely, rotation of the first driven rotation member 352 in the counter-clockwise direction rotates the track ball 344 in the clockwise direction, and applies force to move the carriage plate 312 rightwardly (when viewed from the perspective shown in FIG. 5). Translation of the carriage plate 312 in the left and right directions is limited by the pivot 364 contacting the ends of the lateral dimension 404 of the slot 392. Accordingly, operation of the first driver 376 controls movement of the carriage plate 312 relative to the intermediate plate 308 in the X direction.

Similarly, the output shaft of the second driver 380 is configured to rotate the second driven rotational member 356 about the second axis 388 in both clockwise and counter-clockwise directions. Rotation of the second driven rotational member 356 in the clockwise direction (when viewed from the perspective shown in FIG. 4) rotates the track ball 344 in the counter-clockwise direction (when viewed from the perspective shown in FIG. 4). Frictional contact between the track ball 344 and the carriage plate 312 at the track ball receiving area 348 rotates the track ball 344 in the counter-clockwise direction and applies force in an upward direction to the carriage plate 312 (when viewed from the perspective shown in FIG. 4). Because the pivot 364 cannot slide in the longitudinal dimension 400 within the slot 392, force applied to the carriage plate 312 in the upward direction results in clockwise rotation of the carriage plate 312 about the pivot 364 (when viewed from the perspective shown in FIG. 4). Conversely, rotation of the second driven rotation member 356 in the counter-clockwise direction rotates the track ball 344 in the clockwise direction, and applies force to move the carriage plate 312 downward (when viewed from the perspective shown in FIG. 4). Because the pivot 364 cannot slide in the longitudinal dimension 400 within the slot 392, force applied to the carriage plate in the downward direction results in counter-clockwise rotation of the carriage plate 312 about the pivot 364 (when viewed from the perspective shown in FIG. 4). Accordingly, operation of the second driver 380 controls movement of the carriage plate 312 relative to the intermediate plate 308 in the roll direction. Adjustments in the position of the printhead in the X and roll directions can be made by measuring an error in the position of ejected ink drops in the X and roll directions and compensating for the error by sending control signals to the first driver 376 and second driver 380 to operate the first driven rotational member 352 and the second driven rotational member 356, respectively, to move the carriage plate 312 relative to the intermediate plate 308 in the X and roll directions.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An apparatus for independently aligning printhead position in an ink printing system comprising:

a first member configured for selective mounting of the printhead;

a second member to which the first member is operatively connected;

a first rotational member operatively connected to the second member and positioned to extend from the second member to the first member to frictionally engage the first member;

a first driver operatively connected to the first rotational member to rotate the first rotational member either to translate the first member laterally or to rotate the first member about an axis of the first rotational member.

2. The apparatus of claim 1 wherein the first rotational member is a ball.

3. The apparatus of claim 1 further comprising:

at least one other rotational member operatively connected to an output shaft of the first driver, the at least one other rotational member being positioned to rotate the first rotational member in response to the first driver rotating the output shaft of the first driver.

4. The apparatus of claim 3, the at least one other rotational member further comprising:

a second rotational member and a third rotational member, the second rotational member and the third rotational member being cylindrically shaped and being arranged orthogonally to one another.

5. The apparatus of claim 4 further comprising:

a second driver operatively connected to the third rotational member, the first driver being configured to rotate the second rotational member about a first axis to translate the first member laterally and the second driver being configured to rotate the third rotational member about a second axis to rotate the first member about the axis of the first rotational member.

6. The apparatus of claim 5 further comprising:

a controller operatively connected to the first driver and the second driver to enable the controller to operate the first and the second drivers selectively to move the first member.

7. The apparatus of claim 6, the controller being configured to operate the first and the second drivers to rotate bidirectionally.

8. The apparatus of claim 4 further comprising:

a fourth rotational member mounted to the second member and positioned to urge the first rotational member into the second and the third rotational members.

9. The apparatus of claim 1 further comprising:

a third member extending from the second member to the first member, the first rotational member engaging the first member at a position that enables the third member to operate as a pivot for the first member in response to the first driver rotating the first rotational member to rotate the first member about an axis of the third member.

10. The apparatus of claim 9 further comprising:

a slot in the first member, the third member extending through the slot to limit translation of the first member laterally and to restrain translation of the first member in a longitudinal direction.

11. A method for independently aligning printhead position in an ink printing system comprising:

selectively mounting a printhead to a first member;

operatively connecting the first member to a second member;

operatively connecting a first rotational member to the second member and positioning the first rotational member to extend from the second member to the first member to frictionally engage the first member;

operatively connecting at least one driver to the first rotational member; and rotating the first rotational member with the at least one driver either to translate the first member laterally or to rotate the first member about an axis of the first rotational member.

12. The method of claim 11 further comprising:

operatively connecting at least one other rotational member to an output shaft of the at least one driver; and rotating the output shaft of the at least one driver with the at least one driver to rotate the at least one other rotational member to rotate the first rotational member.

13. The method of claim 12 wherein operatively connecting at least one other rotational member to the output shaft of the at least one driver includes operatively connecting a second rotational member and a third rotational member to the output shaft of the at least one driver and arranging the second rotational member and the third rotational member orthogonally relative to one another.

14. The method of claim 13 wherein operatively connecting a second rotational member and a third rotational member to the output shaft of the at least one driver includes operatively connecting the second rotational member to an output shaft of a first driver and operatively connecting the third rotational member to an output shaft of a second driver.

15. The method of claim 14 further comprising:

rotating the output shaft of the first driver with the first driver to rotate the second rotational member to rotate the first rotational member; and rotating the output shaft of the second driver with the second driver to rotate the third rotational member to rotate the first rotational member.

16. The method of claim 15 wherein:

rotating the output shaft of the first driver with the first driver to rotate the second rotational member includes rotating the second rotational member about a first axis to translate the first member laterally; and rotating the output shaft of the second driver with the second driver to rotate the third rotational member includes rotating the third rotational member about a second axis to rotate the first member about the axis of the first rotational member.

17. The method of claim 14 further comprising:

operatively connecting a controller to the first driver and the second driver; and operating the controller to selectively operate the first driver and the second driver to move the first member.

18. The method of claim 17 wherein operating the controller to selectively operate the first driver and the second driver includes operating the controller to selectively operate the first driver and the second driver to rotate bidirectionally.

19. The method of claim 13 further comprising mounting a fourth rotational member to the second member and positioning the fourth rotational member to urge the first rotational member into the second rotational member and the third rotational member.

20. The method of claim 11 further comprising:

inserting a third member, which extends from the second member to the first member, into a slot in the first member;

engaging the first member with the first rotational member at a position which enables the third member to operate as a pivot for the first member in response to the at least one driver rotating the first rotational member to rotate the first member about the axis of the first rotational member; and limiting movement of the third member to within the slot to limit translation of the first member in a lateral direction and to restrain translation of the first member in a longitudinal direction.

* * * * *